US005915446A

United States Patent [19]

De Zen

[11] Patent Number: 5,915,446

[45] Date of Patent: Jun. 29, 1999

[54] EXTRUDED HINGE MEMBERS AND FOLDING DOORS FORMED THEREFROM

[75] Inventor: Vic De Zen, Woodbridge, Canada

[73] Assignee: Royal Group Technologies Limited, Woodbridge, Canada

[21] Appl. No.: 08/930,980

[22] PCT Filed: Apr. 11, 1996

[86] PCT No.: PCT/CA96/00218

§ 371 Date: Oct. 15, 1997

§ 102(e) Date: Oct. 15, 1997

[87] PCT Pub. No.: WO96/33333

PCT Pub. Date: Oct. 24, 1996

[30] Foreign Application Priority Data

Apr. 18, 1995 [CA] Canada ..... 2147199

[51] Int. Cl.[6] ..... E06B 3/12

[52] U.S. Cl. ..... 160/235; 16/269; 16/386

[58] Field of Search ..... 160/201, 229.1, 160/235, 188, 189, 199; 16/269, 355, 386

[56] References Cited

U.S. PATENT DOCUMENTS 2,968,829 1/1961 Meddick .
3,359,594 12/1967 Pastoor ..... 160/235 X
4,475,268 10/1984 Labelle .
4,532,973 8/1985 De Falco .
4,567,931 2/1986 Wentzel .
4,732,203 3/1988 Alten ..... 160/201 X
4,924,932 5/1990 Esnault ..... 160/235 X

FOREIGN PATENT DOCUMENTS 1127369 9/1968 United Kingdom .

*Primary Examiner*—David M. Purol

[57] ABSTRACT

Hinge member extrusions for use in forming a hinge connection, each member having a front wall and a rear wall and presenting at one edge a generally C-shaped socket formation, the socket formation having a first part circular edge wall segment extending arcuately inwardly of the edge of the front wall to adjacent the rear wall and being connected thereto, and a second part circular arm segment connected to an end of the first part circular wall segment by a web extending inwardly of the first part circular wall segment, the first and second part circular segments having a common center with the radius of the inner surface of the first part circular wall segment being slightly greater than the radius of the outer surface of the second part circular arm segment. Two such hinge members are required in forming a hinge formation to receive a pintle, one of the hinge members has its part circular arm segment connected to its part circular wall segment at the end adjacent the rear wall. The other has its part circular arm section connected to its part circular wall segment at the end at the edge of the front wall.

17 Claims, 4 Drawing Sheets

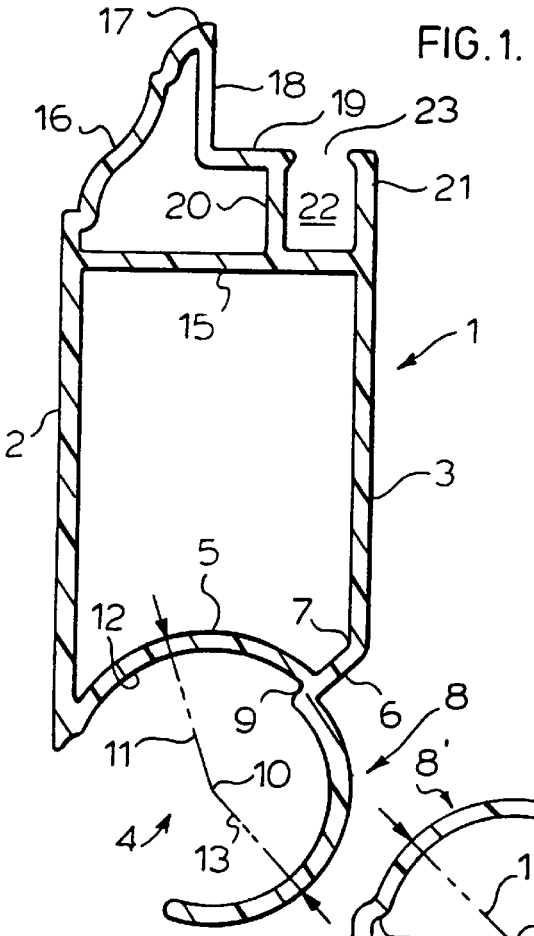
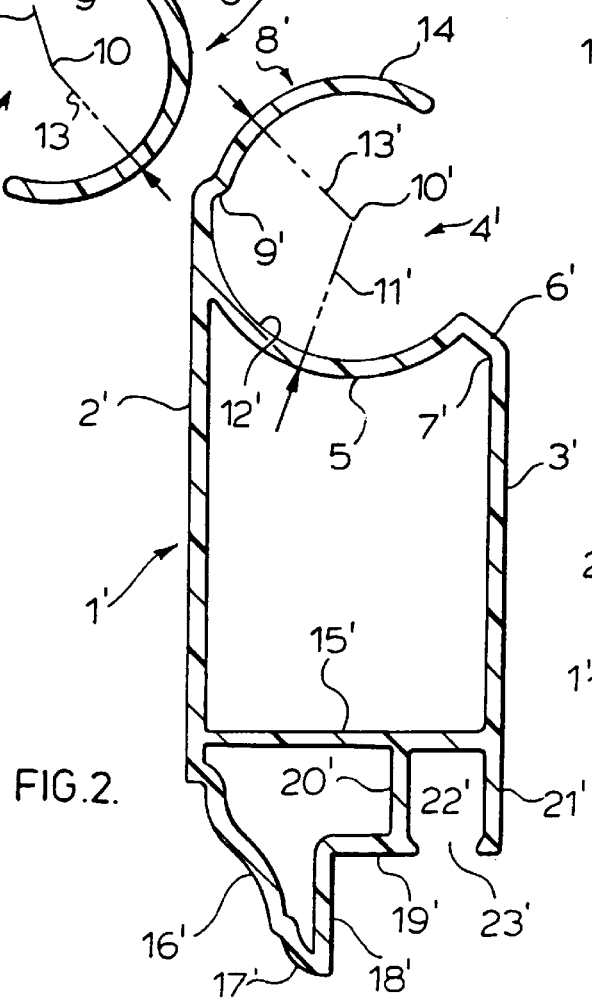
FIG. 2.
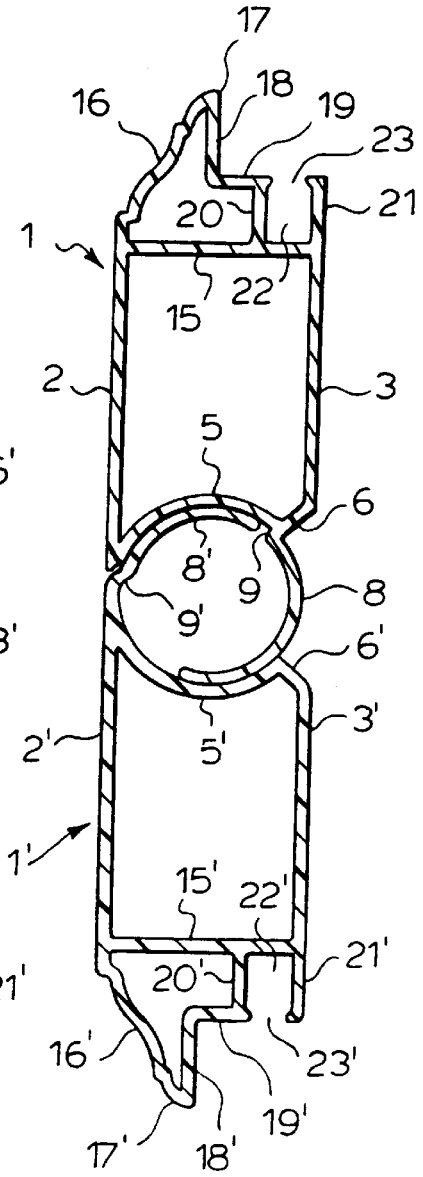

FIG. 4.
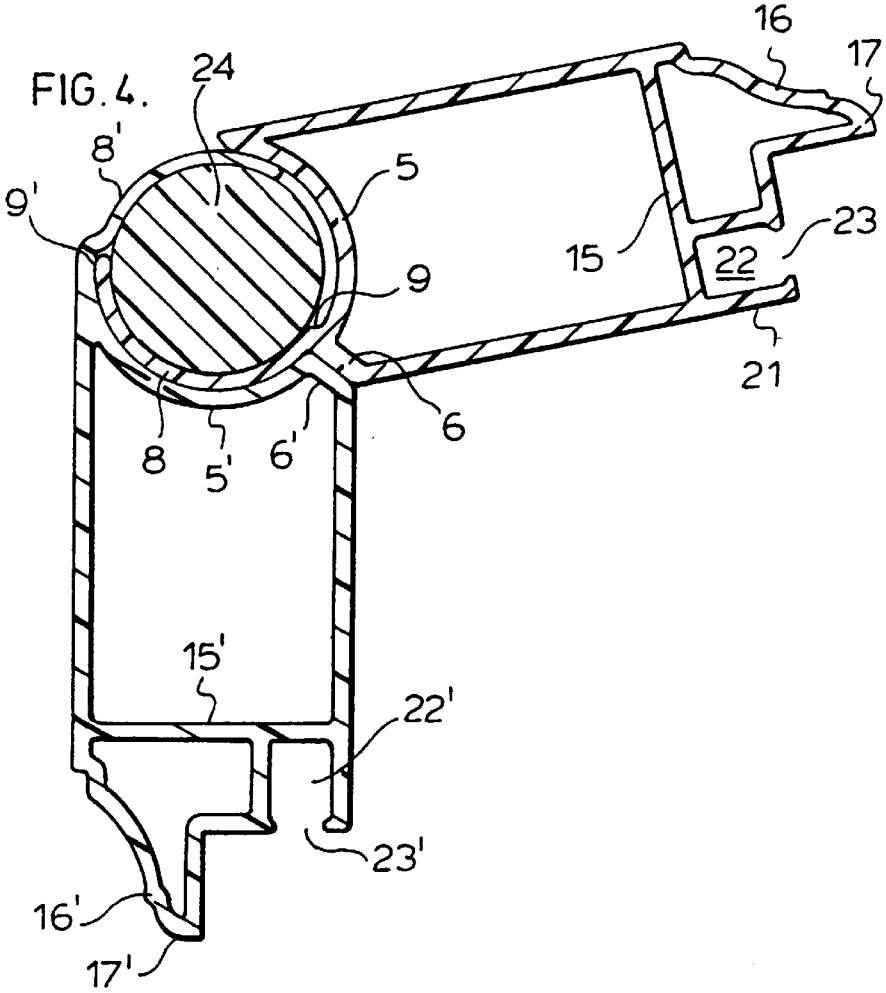
FIG. 5.
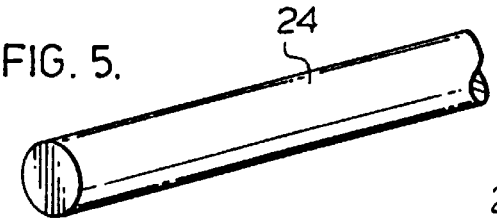
FIG. 6.
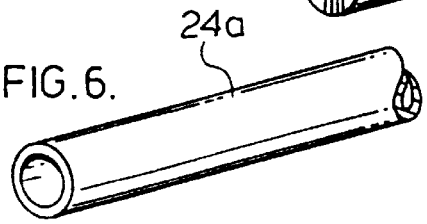
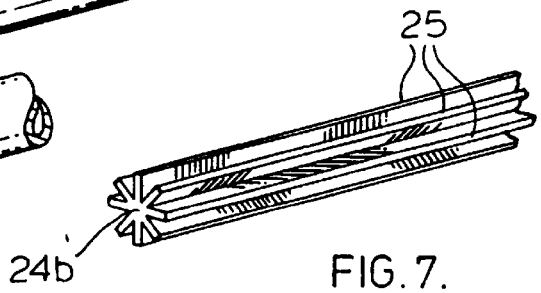
FIG. 7.

EXTRUDED HINGE MEMBERS AND FOLDING DOORS FORMED THEREFROM

FIELD OF THE INVENTION

This invention relates to a novel hinge arrangement particularly adapted for hingedly connecting large panels such as used in overhead folding garage doors and to such doors using the novel hinge arrangement.

BACKGROUND OF THE INVENTION

At present, garage doors are usually formed of rows of wood panels hinged together by a number of separate metal hinges fastened thereto. The doors also have a series of separately mounted rollers at their edges which run in tracks extending upwardly at the sides of the door opening and horizontally inwardly at the top of the door opening so that the door can be moved upwardly and then because of the hinging arrangement move horizontally inwardly at the top of the door opening. Very frequently such folding garage doors are provided with a remote controlled motor to raise and lower the doors in response to a signal from a small transmitter device.

Such garage doors are both expensive to manufacture both from the cost of the wood and the substantial amount of hardware required in the form of hinges and rollers which have to be individually assembled. Moreover, these doors are heavy and awkward to handle, ship and install. The garage door opener mechanisms to handle such heavy doors require motors of significant torque and relatively heavy duties cables, pulleys or other harness for effecting the door movement.

Further, present such doors require maintenance and painting and, when damaged, cannot readily be repaired as the panels cannot be replaced without the removal and dismantling of the door.

It has also been proposed to provide a continuous hinge between two hinge members by forming one member as a male member with a projecting pintle and the other member as a female member having a socket to receive the pintle.

Such arrangements as illustrated in U.S. Pat. Nos. 4,567,931, 4,532,973, and 2,968,829 do not provide the requisite freedom of hinge movement with an adequate connection between the hinge members and the hinge axis is offset to one side of the members.

SUMMARY OF THE INVENTION

It is a feature of the present invention to provide a very simple continuous hinge arrangement involving hinge members which can be readily extruded and in particular can be very economically extruded of thermoplastic material, the hinge arrangement being such that it will provide freedom of movement of the hinge members between predetermined angular positions while providing a strong connection between the hinge members which will preclude their being pulled apart in the operation of even very large overhead folding doors.

It is a further feature to provide such a hinge connection as aforesaid in which the hinge axis is arranged to lie on a line forming the median line between front and rear walls or faces of the hinge members.

The present invention also provides for the provision of a folding door such as an overhead garage door formed essentially or entirely of plastic material which is significantly less expensive to manufacture and significantly lighter than present such doors and does not require any hinge hardware to assemble nor track hardware to run in the tracks at the sides of the door opening.

The invention also provides that the hinge members and doors employing same are adapted to be easily assembled so that they can be shipped in knocked down form and assembled at the point of installation.

By forming the hinges and panels of plastic material, the components require no maintenance and the arrangement is such that if the door panel becomes damaged it may be simply and easily replaced without having to remove the door from its installed position or disturb the other panels.

Moreover, because of the light weight of the hinge and door components, lighter duty and less expensive door operating equipment can be employed to provide additional cost savings.

More particularly, the invention involves the provision of hinge members in the form of longitudinal extrusions for use in forming a hinge connection, the hinge members comprising first and second hinge members each having a front wall and a rear wall and presenting at one edge a generally C-shaped socket formation having two part circular segments having a common center and different radii. One of the part circular segments forms a reentrant edge wall segment extending arcuately inwardly from the edge of the front wall to adjacent the rear wall and being connected thereto, and the other of the part circular segments comprises a curved arm forming part of a circle connected to an end of the part circular wall segment and curving outwardly beyond the front and rear walls of the member, the radius of the inner surface of the part circular wall segment being slightly greater than the radius of the outer surface of the part circular arm segment.

The first hinge member has its part circular arm segment connected to its part circular wall segment adjacent to its rear wall, while the second member has its part circular arm segment connected to its part circular wall segment at its front wall.

The arrangement is such that the part circular arm segment of the first hinge member is adapted to rotate on the part circular wall segment of the second hinge member and vice versa, and the part circular arm segments are adapted to form a hinge barrel formation for receiving a hinge pintle for rotational movement thereabout centered on said common center. The hinge members are also provided with means whereby a connection can be effected to panel members to be hinged.

According to the preferred form of the invention, the extruded hinge members have parallel front and rear walls and the common center of the part circular segments of the C-shaped formations lie on the median between the front and rear walls.

The invention also includes folding structures such as overhead doors employing such hinge members to hingedly connect door panels and, according to the preferred embodiment of this aspect of the invention, the door panels are releasable secured at the longitudinal edges of the hinge members opposite to the C-shaped edges.

According to another aspect of the preferred form of the invention as it relates to the doors, the edges of the panels at the edges of the doors are releasable secured to an edge rail or frame member having an outwardly extending spine notched to provide cog teeth adapted to run in a trackway at the edge of the door with the cog teeth being adapted for engagement with the drive of a garage door opener mechanisms.

These and other features of the invention will be understood from the following detailed description taken in conjunction with the accompanying drawings.

BRIEF DESCRIPTION OF THE DRAWINGS

FIG. 1 is an end elevational view showing the profile of one of the hinge elements which, in a folding overhead garage door or the like, forms the top hinge element;

FIG. 2 is an end elevational view showing the profile of the other hinge element which forms the bottom hinge element in a folding overhead garage door or the like;

FIG. 3 shows the hinge elements of FIGS. 1 and 2 assembled ready to receive a hinge pintle with the front walls of the hinge elements in alignment;

FIG. 4 illustrates the hinge elements of FIGS. 1 and 2 swung about a pintle to a limit hinged position;

FIGS. 5, 6 and 7 are broken away perspective views of various forms of pintles;

Figure 8:
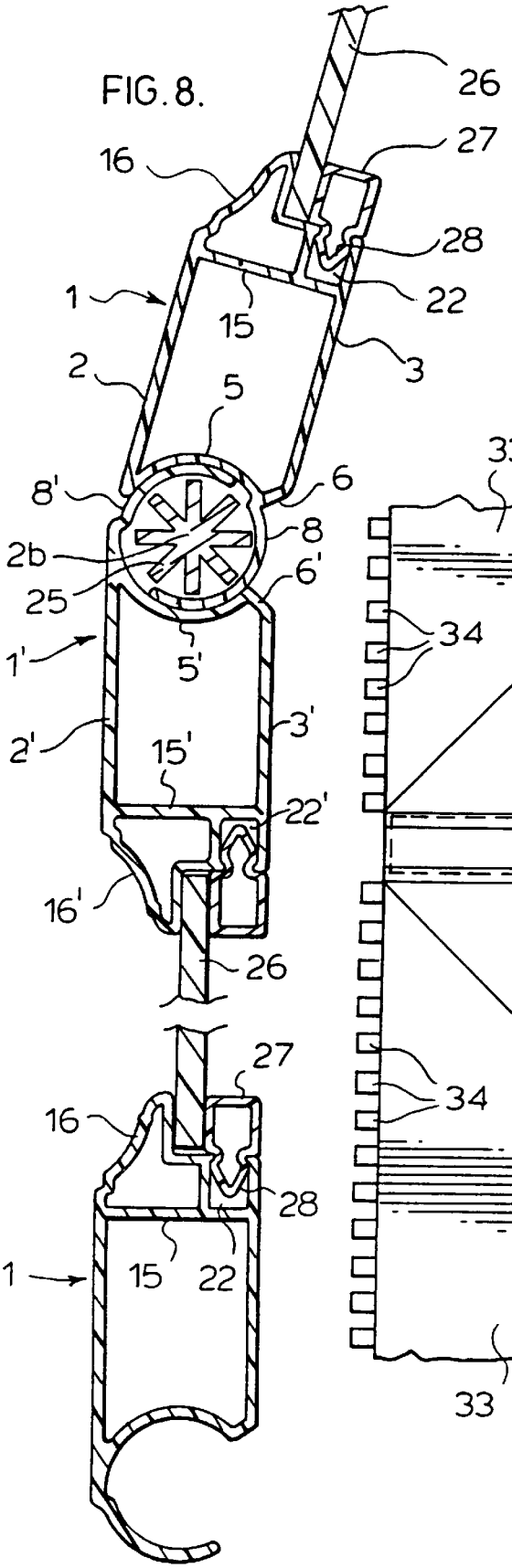
FIG. 8 is a broken away sectional view showing the hinge connection of one pair of hinge members and illustrating the manner in which the door panels are removeably secured to these hinge members.

DETAILED DESCRIPTION ACCORDING TO THE PREFERRED EMBODIMENTS OF THE PRESENT INVENTION

It will be understood that the novel hinges of the present invention have wide application but because of their simplicity, strength and free hinging action have particular importance in large hinging structures such as large folding doors, i.e. large overhead garage doors or the like and will be described with reference thereto.

With reference to FIG. 1, the hinge member designated at 1 which is to form the top hinge member in a folding overhead garage door or the like comprises a longitudinal extrusion in the form of a hollow bar having a front wall 2 and a rear wall 3 secured in spaced parallel relation.

The lower longitudinal edge of the hinge member or bar 1 is formed to present a generally C-shaped socket formation designated at 4.

This socket formation 4 has a first part circular edge wall segment 5 extending arcuately inwardly of the edge of the front wall 2 to adjacent the rear wall 3 to which it is joined by a short web 6 forming an obtuse angle 7 with the rear wall.

This wall segment 5 thus forms an arcuate reentrant wall extending the major portion of the distance of the width of the hinge member 1.

The C-shaped socket formation 4 has a second part circular segment in the form of a curved arm 8 forming part of a circle connected to the inner end of the wall segment 5 by an inward extension of the web 6 forming a shoulder 9 at the juncture of the inner end of the wall segment 5 and the commencement of the part circular arm 8.

The part circular wall segment 5 and part circular arm 8 have a common center indicated at 10 lying on a line forming the median between the front and rear walls 2 and 3.

The wall and arm segments 5 and 8 have different radii with the radius 11 of the concave inside surface 12 of the part circular wall segment 5 being just slightly greater than the radius 13 of the outside convex surface 14 of the part circular arm segment 8.

The front and rear walls 2 and 3 are connected adjacent the upper edge of the hinge member 1 by a transverse web 15 and sloping upwardly and inwardly from the front wall 2 is a wall 16 forming a generally triangular peak 17 with a downwardly extending return wall 18 parallel to the front and rear walls 2 and 3 and offset towards the front wall from the median between the front and rear walls.

The return wall 18 terminates in a shoulder 19 centered on the median of the front and rear walls and connected to the web 15 by a wall 20 which with the upper portion 21 of the rear wall 3 forms a channel 22 which is necked in at its mouth to provide a slightly restricted entrance 23.

The hinge member or bar 1 is adapted to interengage with a mating hinge bar or member 1' which in an overhead folding door installation is to form the bottom member of the hinge.

The hinge member 1' as in the case of the hinge member 1 comprises a longitudinal extrusion in the form of a hollow bar having parallel front and rear walls 2' and 3' respectively and having a C-shaped socket formation designated at 4' which in the case of the hinge bar 1' is formed at the top edge of the member.

The C-shaped socket formation 4' has a first part circular edge wall segment 5' extending arcuately inwardly of the edge of the front wall 2' to adjacent the rear wall 3' being joined thereto by a web 6' forming an obtuse angle 7' with rear wall 3'.

The second segment of the C-shaped formation 4' of the hinge member 1' again comprises a part circular arm 8' which in this case is connected to the forward end of the wall segment 5' by a shoulder 9'. The part circular wall segment 5' and part circular arm 8' have a common center designated at 10' which again is located on the median of the front and rear walls 2' and 3'.

As in the case of the hinge member 1, the part circular wall segment 5' and the part circular arm 8' have different radii with the radius 11' of the inner concave surface 12' of the wall segment 5' being slightly greater than the radius 13' of the outside convex surface 14' of the part circular arm segment 8'.

The radius 11' of the concave surface 12' of the wall segment 5' of the hinge member 1' is the same as the radius 11 of the concave surface 12 of the wall segment 5 of the hinge member 1. Similarly, the radius 13' of the outside convex surface 14' of the arm segment 8' of the hinge member 1' is the same as the radius 13 of the outside convex surface 14 of the arm segment 8 of the hinge member 1 with the length of the part circular arm segment 8 of the hinge member being slightly greater than the length of the part circular arm segment 8' of the hinge member 1'.

The hinge member 1' has the same formation at its lower edge as the hinge member 1 has at its upper edge with the walls 2' and 3' being connected by web 15' and having a downwardly and inwardly sloping wall 16' forming a triangular peak 17' with an upwardly extending wall 18' which is parallel to the front and rear walls 2' and 3' and on the forward side of the median of the front and rear walls 2' and 3'. The wall 18' forms a shoulder 19' with a wall 20' which forms with a lower portion 21' of the rear wall 3' a channel 22' having a restricted entrance 23'.

The hinge members or bars 1 and 1' may be readily extruded and are particularly adapted to be extruded from a suitable plastic material such as PVC, vinyl or ABS or mixtures thereof and may include appropriate fillers or stiffening agents such as calcium carbonate as will be understood by those skilled in the art.

With reference to FIG. 3, the hinge members or bars 1 and 1' are shown interengaged ready to receive a hinge pintle and with their front walls 2 and 2' in alignment.

As it will be seen, the outer surface 14 of the part circular arm 8 engages the inner concave surface 12' of the part circular wall segment 5' of the hinge member 1' while the outside convex surface 14' of the part circular arm 8' engages the inside concave surface 12 of the part circular wall segment 5 with the shoulders 9 and 9' providing stop surfaces to limit forward hinging movement between the members 1 and 1'.

With the hinge members assembled as illustrated in FIG. 3, the centers 10 and 10' will then coincide.

It will be understood that the C-shaped socket formations 4 and 4' can be readily assembled into the position shown in FIG. 3 but that they require the introduction of a hinge pintle 24 as shown in FIG. 4 to hold them in place.

As shown in FIG. 4, the hinge member 1 has been swung rearwardly of the hinge member 1' until the webs 6 and 6' abut which limits further hinging movement. In this position, as illustrated in FIG. 4, the free end of the part circular arm 8 essentially abuts the inside surface of the shoulder 9' at the inner end of the part circular arm 8'.

With the arrangement illustrated, the part circular wall segments 5 and 5' form strong bearing surfaces for supporting and guiding the part circular arms 8 and 8' in the hinging action while the part circular arms 8 and 8' themselves form hinge barrel elements to receive the hinge pin or pintle 24 which has a simple circular cross-section and when inserted into the hinge barrel formation presented by the arms 8 and 8' has its center centered on the median of the front and rear walls of the hinge members 1 and 1'.

This combination provides an extremely effective free hinging movement and at the same time provides a hinge capable of withstanding forces tending to separate the hinge members in the operation of a large folding overhead garage door or the like.

The hinge pintle 24 may simply be a longitudinal rod of circular section having a diameter to fit snuggly within the part circular arms 8 and 8' and it may be formed either as an extruded rod of high strength plastic material or it may be a metal bar.

Similarly the tubular pintle 24*a* of FIG. 6 may be of extruded plastic or may be a tubular metal bar.

The pintle 24*b* illustrated in FIG. 7 is preferably extruded of high density polyethylene to provide a series of outwardly extending spokes or vanes 25 having only the tips thereof engaging the part circular arms 8 and 8'.

The pintle 24*b* provides a minimum of friction and in effect is self-lubricating.

FIG. 8 illustrates how the panels 26 are removeably connected to the hinge elements 1 and 1' in the forming of an overhead garage door or the like. These panels 26 which preferably are formed of a suitable plastic material such as foamed PVC and may be plain panels or may be vacuum formed to provide any desired decorative design are adapted to seat in the case of the hinge element 1 on the shoulder 19. The panels are held against the wall 18 by a longitudinal extruded hollow bar stop 27 having a spear head 28 adapted to resiliently interengage with the restricted entrance 23.

Similarly, in the case of the hinge element 1' the panels 26 which seats on the shoulder 19' are held against the stop wall 20' by a stop bar 27.

Figure 10:
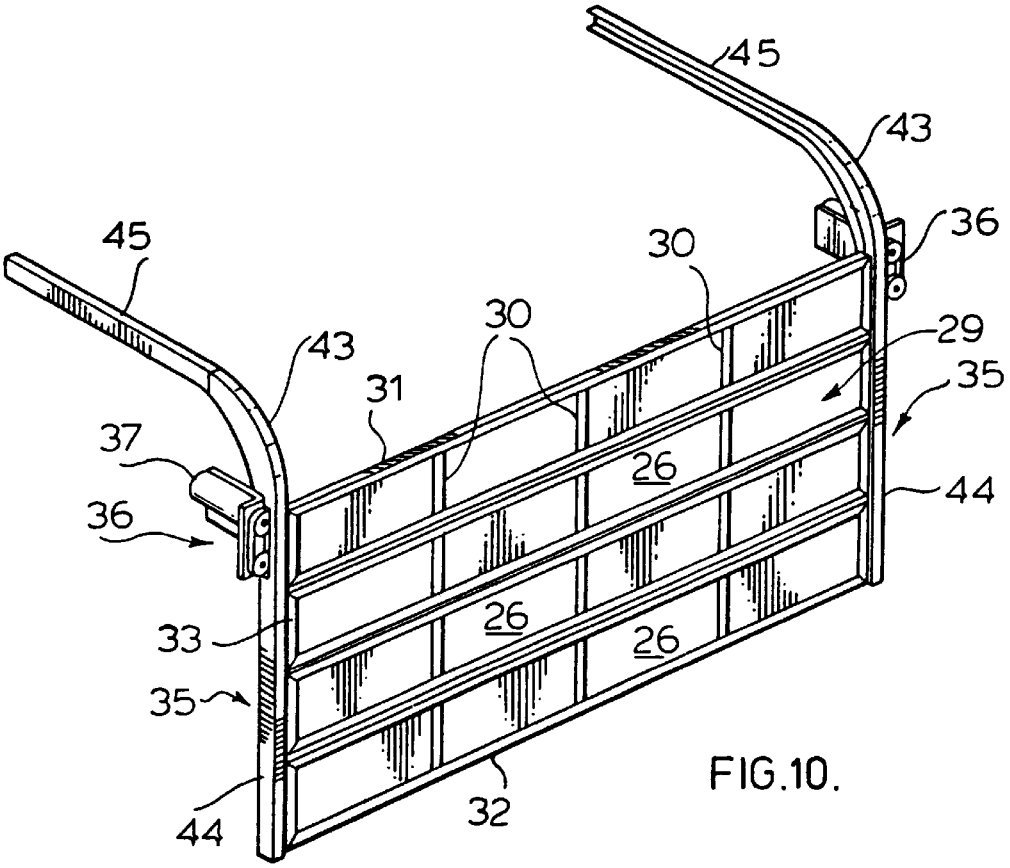
FIG. 10 is a diagrammatic perspective view illustrating a garage door incorporating the invention mounted for sliding and folding engagement in trackways at either side of the door opening (not shown)

It will be understood as illustrated in FIG. 10, that a large garage door or the like will be made up of transverse rows of panels 26 while the hinge elements 1 and 1' extend the full width of the door generally designated at 29.

Each of the panels 26 is removeably secured to intermediate members 30, top and bottom members 31 and 32, and side rails 33 respectively preferably in the same manner as the panels are secured to the longitudinal edges of the hinge members 1 and 1'.

Figure 9:
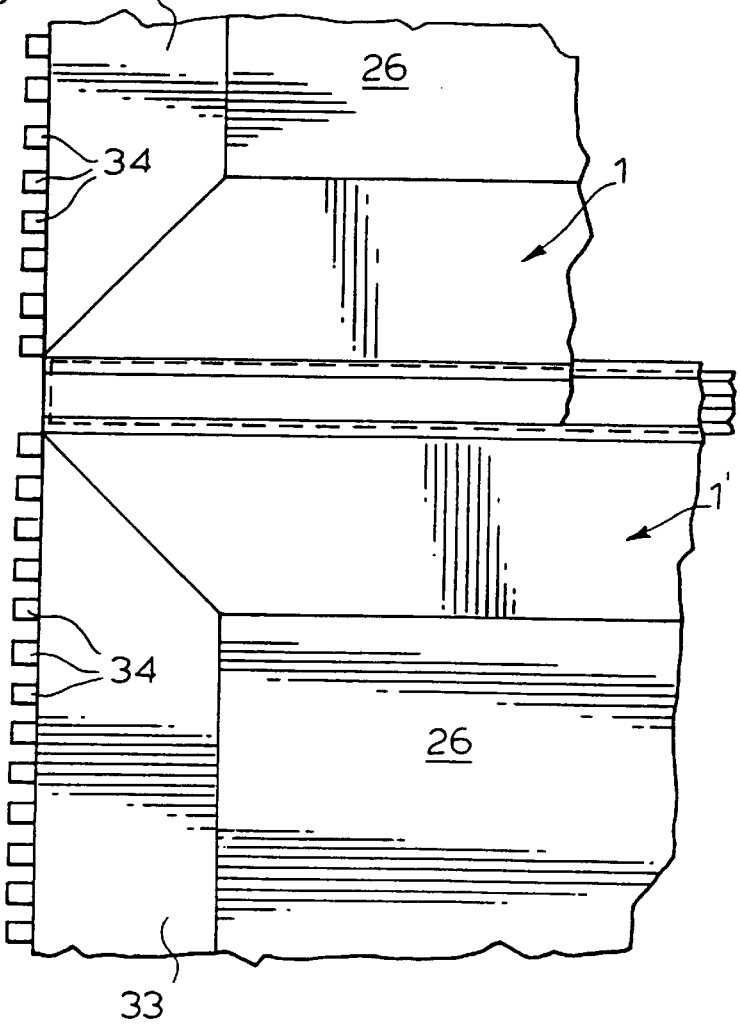
FIG. 9 is a broken away view of a folding garage door or the like showing the edge frame rails provided with cog teeth at the edges of two hinged door panel rows.
Figure 12:
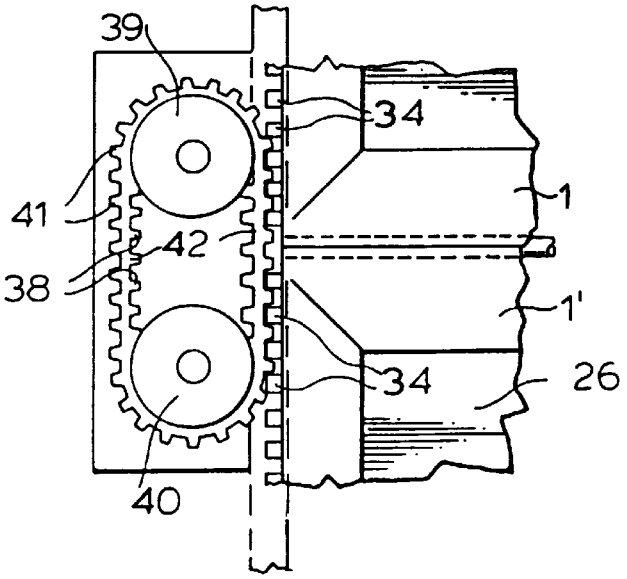
FIG. 12 is a part front elevational part broken away view showing one form of drive mechanism for raising and lowering the folding door.

As illustrated in FIGS. 9 and 12, the side rails 33 are provided with projecting spines that are notched to present cog teeth 34 which are adapted to extend into door tracks 35 arranged at each side of the door 29.

These cog teeth 34 are adapted to be engaged by a suitable garage door opening mechanism here shown as a motor driven belt drive generally designated at 36 at each side of the door driven by small synchronous motors 37.

As illustrated in FIG. 12, each motor 37 drives a belt 38 (only one being shown) through a drive sprocket 39 and idler sprocket 40, the belt having projecting cogs 41 which engage the cog teeth 34 of the edge frame bars or siderails 33 and projecting cogs 42 which engage the sprockets 39 and 40.

Figure 11:
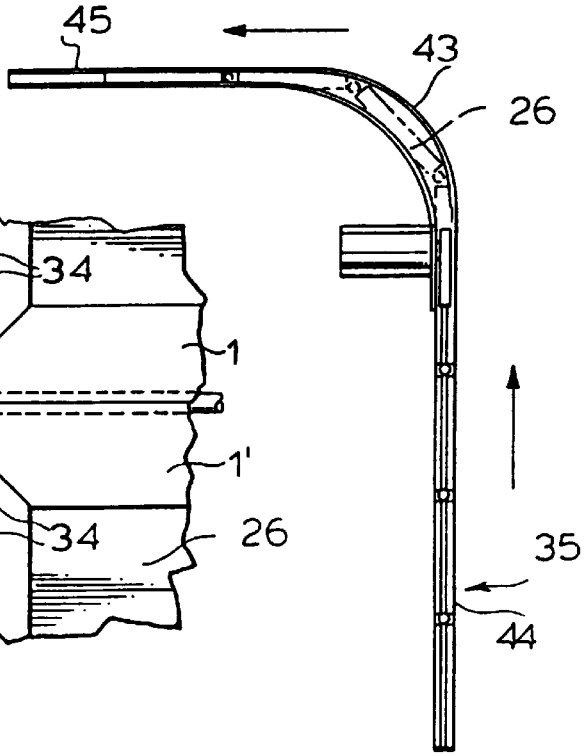
FIG. 11 is a diagrammatic view illustrating how the hinged panels of the door are guided from vertical to horizontal movement at the top of the door opening.

As illustrated in FIGS. 10 and 11, the garage door tracks 35 as they curve as at 43 from the vertical section 44 to the horizontal section 45 are widened to accommodate the movement of the cog teeth 34 extending from the edges of the siderails 33 therethrough as the door panels 26 pivot relative to each other.

It will be understood that the door panels 26, the hinge members or bars 1 and 1', the top, bottom and siderails 31, 32 and 33 respectively all formed of suitable thermoplastic material may contain colour agents, ultraviolet light protecting agents and the like as will be understood by those skilled in the art.

With hinges constructed according with the invention, it will be appreciated that the invention provides for the production of large overhead doors which may be single or double garage doors which can be easily and inexpensively manufactured and easily assembled at a cost much lower than the conventional garage doors without requiring any of the extensive hardware of such doors. Moreover, their ability to be assembled in the field and their light weight which allows for easy handling, transporting and installing also enables the use of low torque garage opening mechanisms.

It will be understood variations in the details of the hinge elements and doors formed therefrom may be made without departing from the scope of the appended claims.

The embodiments of the invention in which an exclusive property or privilege is claimed are defined as follows:

1. An extruded thermoplastic hinge member for use in forming a hinge connection, said member having a front wall and a rear wall and a generally C-shaped socket formation at one end of said hinge member, said socket formation comprising a first part circular segment which curves inwardly between said front and rear walls and a second part circular segment connected by a first web to one end of said first segment, both segments having a common center, said first segment having an inner surface spaced by a first distance and said second segment having an outside surface spaced by a second distance from the common center, the first distance being slightly greater than the second distance.

2. A hinge member as claimed in claim 1, wherein the end of the first segment to which the second segment is connected is located adjacent the rear wall of said hinge member.

3. A hinge member as claimed in claim 1, wherein the end of the first segment to which said second segment is connected is located adjacent the front wall of said hinge member.

4. A hinge member is claimed in claims 1, 2 or 3 in which said first web forms a stop shoulder where said second segment is connected to said first segment.

5. A hinge member as claimed in claims 1, 2 or 3 in which said first segment is connected to said rear wall by a second web forming an obtuse angle with said rear wall.

6. First and second hinge members extruded from thermoplastic material and adapted for part rotational interengagement for use in forming a hinge connection, each of said hinge members having a front wall and a rear wall and a generally C-shaped socket formation at one end of each hinge member, each socket formation having first and second part circular segments having a common center, said first segment having an inner surface spaced by a first distance and said second segment having an outer surface spaced by a second distance from said common center, the first distance being slightly greater than the second distance, said first segment forming a reentrant end wall extending arcuately inwardly between the front and rear walls at the one end of each hinge member, the second segment being connected to the first segment and extending outwardly therefrom on each hinge member, the second segment being located near the rear wall of the first hinge member and the second segment being located near the front wall of the second hinge member such that the socket formations of the first and second hinge members couple with one another to form a barrel hinge for receiving a hinge pin.

7. First and second hinge members as claimed in claim 6, in which the front and rear walls of each hinge member are parallel and the common center for the first and second segments lies on a line between said front and rear walls.

8. First and second hinge members as claimed in claims 6 or 7 in which the second segment of the first hinge member is longer than the second segment of the second hinge member.

9. First and second hinge members as claimed in claims 6 or 7 wherein the first and second segments of each hinge member are connected by webs which form stop ledges in each socket formation.

10. A folding door comprising a plurality of transverse rows of door panels of plastic material hingedly connected by a plurality of transverse spaced hinges comprising first and second extruded hollow thermoplastic hinge bars each of which has a front wall and a rear wall and each hinge bar having at a first edge thereof a generally C-shaped socket formation and along a second edge opposite the first edge each hinge bar being provided with door panel engaging means, each socket formation having first and second part circular segments both having a common center, said first segment forming a reentrant edge wall extending arcuately inwardly between the front and rear walls of each hinge bar, the second segment being connected to one end of the first segment and curving out beyond the front and rear walls of each hinge bar, in each socket formation the first segment having an inner surface which is spaced slightly farther away from the common center than an outer surface of said second segment, in said first hinge bar said second segment being connected to said first segment adjacent the rear wall thereof, in said second hinge bar said second segment being connected to said first segment adjacent the front wall thereof such that the socket formations of said first and second hinge bars couple with one another to form a hinge barrel which is fitted with a hinge pintle.

11. A door as claimed in claim 10 in which said front and rear walls are parallel and said common center for said part circular segments lies on a median line between said front and rear walls.

12. A garage door as claimed in claims 10 or 11 in which said pintle is a polyethylene rod having radially projecting vanes which engage the walls of said hinge barrel to provide a self-lubricating hinge.

13. A door as claimed in claim 10 in which said second segment of said first hinge bar is connected by a web at an angle obtuse to the rear wall thereof and wherein said second segment of said second hinge bar is connected by a web at an angle obtuse to the front wall thereof.

14. A door as claimed in claim 10, in which the first and second segments in each formation are connected by connecting webs which form stop ledges in the formations.

15. A door as claimed in claims 10 or 11 in which the second segment of the formation of the first hinge bar is longer than the second segment of the formation of the second hinge bar.

16. A folding door as claimed in claim 10 wherein said door panels have side edges which are fitted with edge frame rails provided with cog teeth projecting therefrom to extend into a trackway bordering a door opening to be closed by said door.

17. A folding door as claimed in claim 16, wherein motor means is provided in said trackway to engage said cog teeth for opening and closing said door.

* * * * *